United States Patent [19]

Hidvégi

[11] Patent Number: 4,717,342

[45] Date of Patent: Jan. 5, 1988

[54] COMBINABLE SET OF QUADRATIC ELEMENTS

[75] Inventor: Valéria Hidvégi, Budapest, Hungary

[73] Assignee: Piky S. A.

[21] Appl. No.: 784,882

[22] PCT Filed: Jan. 28, 1985

[86] PCT No.: PCT/HU85/00004

§ 371 Date: Sep. 30, 1985

§ 102(e) Date: Sep. 30, 1985

[87] PCT Pub. No.: WO85/03453

PCT Pub. Date: Aug. 15, 1985

[30] Foreign Application Priority Data

Jan. 31, 1984 [HU] Hungary ..... 418/84

[51] Int. Cl.[4] ..... G09B 1/32

[52] U.S. Cl. ..... 434/96; 273/157 R

[58] Field of Search ..... 273/239, 285, 146, 157 R; 434/96, 97, 429

[56] References Cited

U.S. PATENT DOCUMENTS

| | | | |
|---|---|---|---|
| D. 184,396 | 2/1959 | Jenkins | 434/96 X |
| 1,475,112 | 11/1923 | Grimes et al. | 434/96 |
| 1,492,671 | 5/1924 | Bruel | 434/96 |
| 1,560,994 | 11/1925 | Jones | 434/429 |
| 1,849,676 | 3/1932 | Loewenthal | 273/285 |
| 1,973,564 | 9/1934 | Graham | 434/96 |
| 2,399,041 | 4/1946 | Kleber | 273/285 |
| 3,464,145 | 9/1969 | Martin | 434/96 X |
| 3,608,904 | 9/1971 | Margetson | 273/288 |
| 3,831,295 | 8/1974 | Mackay | 434/236 |
| 4,275,887 | 6/1981 | Tateyama | 273/285 X |
| 4,371,168 | 2/1983 | Dupuis | 273/285 |

FOREIGN PATENT DOCUMENTS

| | | | |
|---|---|---|---|
| 735134 | 5/1943 | Fed. Rep. of Germany | 273/285 |
| 1561934 | 4/1969 | France . | |
| 2462178 | 2/1981 | France . | |
| 2474878 | 8/1981 | France | 273/268 |
| 2514178 | 4/1983 | France | 434/96 |
| 8000038 | 8/1981 | Netherlands | 434/96 |
| 8101523 | 6/1981 | World Int. Prop. O. | 434/96 |
| 219310 | 12/1926 | United Kingdom | 434/96 |
| 589137 | 6/1947 | United Kingdom | 434/96 |

*Primary Examiner*—William H. Grieb

*Attorney, Agent, or Firm*—Michael N. Meller

[57] ABSTRACT

A set of elements have square surfaces with patterns thereon, the elements being arrangeable such that the square surfaces are juxtaposed to form a design. The patterns are defined by one or two contour lines on the square surface, the surface areas on either side of each contour being different colors. The square surfaces have patterns belonging to two groups or have no pattern thereon. The first group includes square surfaces having only circular arcs as contour lines and the second group includes square surfaces having only straight lines as contour lines. The first group includes four types and the second group includes two types.

15 Claims, 14 Drawing Figures

COMBINABLE SET OF QUADRATIC ELEMENTS

Figure 1:
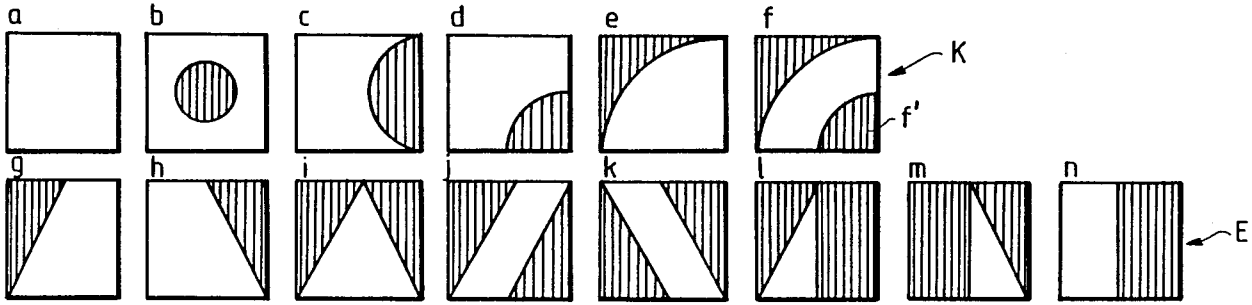

The invention relates to a combination set of elements for setting surfaces with patterns and/or shapes of variable designs, particularly for applications as a toy or as a surface covering, in which each element comprises a square surface that can be grouped in types of different appearance, and the number of elements is substantially greater than that of the types.

There exist a large number of toys by which various surfaces can be formed. Of these toys the most popular ones are the so called "puzzle toys", in which the task lies in that a picture should be formed by elements having irregular forms which comprise small fragments of the picture.

The common properties of the puzzle toys lie in that there exists only one correct arrangement of the elements, furthermore the elements fill continuously the full picture area and neither the shape nor the pattern of the elements are identical.

A conventional way of forming surfaces illustrating a picture or a decorative pattern by means of elements is the use of mosaics. In the mosaic arts the respective coloured stones are broken in shapes corresponding to the form of a detail of the picutre to be set, and the colours are carefully selected. The elements cannot be therefore grouped according to their colours or shapes. There are several mosaic toys in conventional toy shops which consist of uni-coloured elements of predetermined uniform shapes having mostly the form of a rhomboid. These toys are capable of forming many decorative surfaces. Regarding the form of the patterns that can be formed by such toys, the shape of the elements has a limiting and decisive role. Due to the linear contour lines of the elements, such mosaic toys cannot be used for forming patterns with curved contours considered beautiful by the norms of human aesthetic sense.

There are other types of toys capable of forming surfaces which comprise elements of different forms, such as the various construction building sets made of wood which are suitable for forming a large number of spatial and planar patterns. These toys cannot always fill a whole surface area and the often large number of the types of elements with various sizes and forms makes their storage in a box difficult and causes problems during selection of the desired elements. The size of such elements is rather large, therefore they are rarely suitable for making figures with fine details.

There are other toys of the setting type which comprise elements that are arranged in a raster network on a boarding table and each element represents respective small areas /raster points/ of a picture, whereby a practically unlimited number of pictures can be set. Such toys are of the type in which the elements are formed by small coloured rectangles or discs /or rings/. By means of these toys aesthetically pleasing pictures can be set, however, the setting of pleasant pictures requires long playing times and the use of a large number of elements, which work often makes the children tired and does not offer them a feeling of success in a short time. In addition to these problems a further difficulty arises if the small elements should be stored in a box in a regular arrangement.

A general drawback of the non-puzzle-like setting toys lies in that the forms of the individual elements do not allow the setting of patterns with arced or curved contour lines. In the case where elements with linear contours are used, steps are formed when curved sections are to be set, which is aesthetically disturbing, while the disc-like elements cannot be used for forming patterns with linear contours.

In addition to the setting toys there are other kinds of toys which comprise flat quadratic prisms as elements and each element has a letter or number written on its upper face. The elements are arranged in sets which include several pieces of every letter or number, whereby words or short sentences can be set. Such toys are intended mainly for children ages 5 to 7. When words are formed by such elements the patterns on their faces /the letters/ impose distinct visual impressions on the viewer. The letters in the adjacent elements will be related to each other indirectly only i.e. through the word-forming logic of the human mind, and these elements are inappropriate for setting pictorial images.

The above-described problems connected with the toy sets of the setting type occur not only in the toy field but also in a more general sphere. One can appreciate that the aesthetical forms, the richness in details and the general appearance of various surface coverings are largely determined and limited by the form and appearance of the elements from which the surfaces are set.

The object of the invention is to provide a combination set of elements by which the above-outlined drawbacks can be overcome and in which by the use of a comparatively small number of elements, a large number of decorative patterns and forms can be set according to the actual creative spirit, talent or aesthetic demand of the player and in which the exercise can help the players in learning the harmony of the colours and in developing their aesthetic skills.

According to the invention a combination set of elements has been provided for setting surfaces with patterns and/or shapes of variable design, particularly for applications as a toy or as a surface covering, in which each element comprises a square surface, the square surfaces can be grouped in types having different appearances, and the number of elements is substantially higher than the number of types. According to the invention the types differ from each other in the number, form and/or position of geometrical patterns made on and differing from the surfaces, and the types of elements with pattern can be classified on the basis of the form of internal contour lines of the patterns either in a linear or in a circularly arced group. For every pattern in the linear group, a pair of apex points are located at both ends of a first side of the square and one or two further apex points are located at the midpoint of or points of the side one or more sides of the square that intercept the first side. For every pattern in the arced group the diameter of every arced section is a multiple of the half of the side length of the square and the centrum of every arced circular section is located on a corner, a side midpoint or the centre of the square.

This set of elements can be considered as a substantial improvement of the aforementioned toy set for displaying words or sentences. The decisive difference lies in that the geometric patterns formed on the upper surface will be mutually interrelated and in this way a large number of designs can be set. The combined application of patterns with linear and curved contour lines facilitates the displaying of shapes with curved boundary lines. A substantial advantage results from the design of the shape of the patterns to depend on the half-length of the square elements because this determines a certain regularity for the shapes that can be set.

According to a preferred embodiment the set comprises types in which two or more separate patterns of the same group are arranged on the square surface. Under the term "separate" it should be understood that in an element the patterns cannot overlap each other.

It is preferable to use types in which each element comprises more than one pattern of the same form. The number of possible combinations can be increased by using types of elements in which a pair of arced patterns are arranged on the square surface and the two arced sections have different radii and a common centre located at a corner of the square.

In a further preferred embodiment the patterns are distinguished from the corresponding surfaces by their colours. In this case it is preferable if each pattern and each area of the surfaces left uncovered by any pattern has a respective homogenous colour, the colours used in the set being selected from three basic colours, i.e. blue, red and yellow, or from two predetermined mixtures of any pair of said basic colours, and the maximum number of colours that can be used on a square surface is three.

The number of possibilities is further increased if the set includes squares having a uni-coloured surface without any pattern, the types of such squares differing from each other in colour.

The number of combinations will be further increased if the elements have different sizes and are allocated in groups in which the side lengths of the square surfaces form a mathematical series with a length ratio of 1:2 between adjacent numbers, and within each group the types being at least partially repeated.

For the implementation of the set it is preferable if the elements are made of flat square prisms with respective hard magnetic layers in their bottoms for engagement with a soft magnetic layer formed on the upper surface of a playing board provided with a linear grid. For facilitating the distinction between the types respective markings associated with the actual types can be formed on the side faces of the elements.

A further possibility of designing the set according to the invention lies in that the elements can be made in the form of a cube, which have a plurality of surfaces that belong to respective ones of the types.

The toy set according to the invention will now be described on the basis of exemplary embodiments thereof in which reference will be made to the accompanying drawings.

Figure 3:
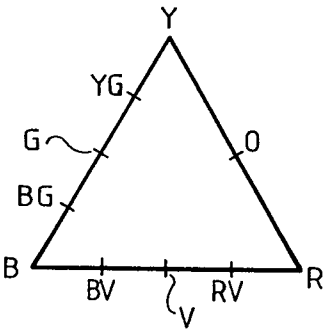
Figure 2:
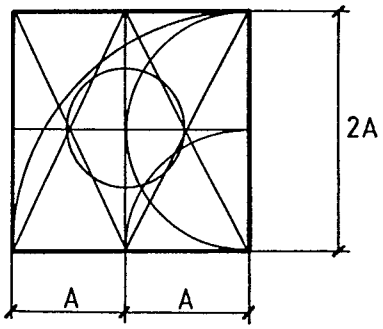
Figure 6:
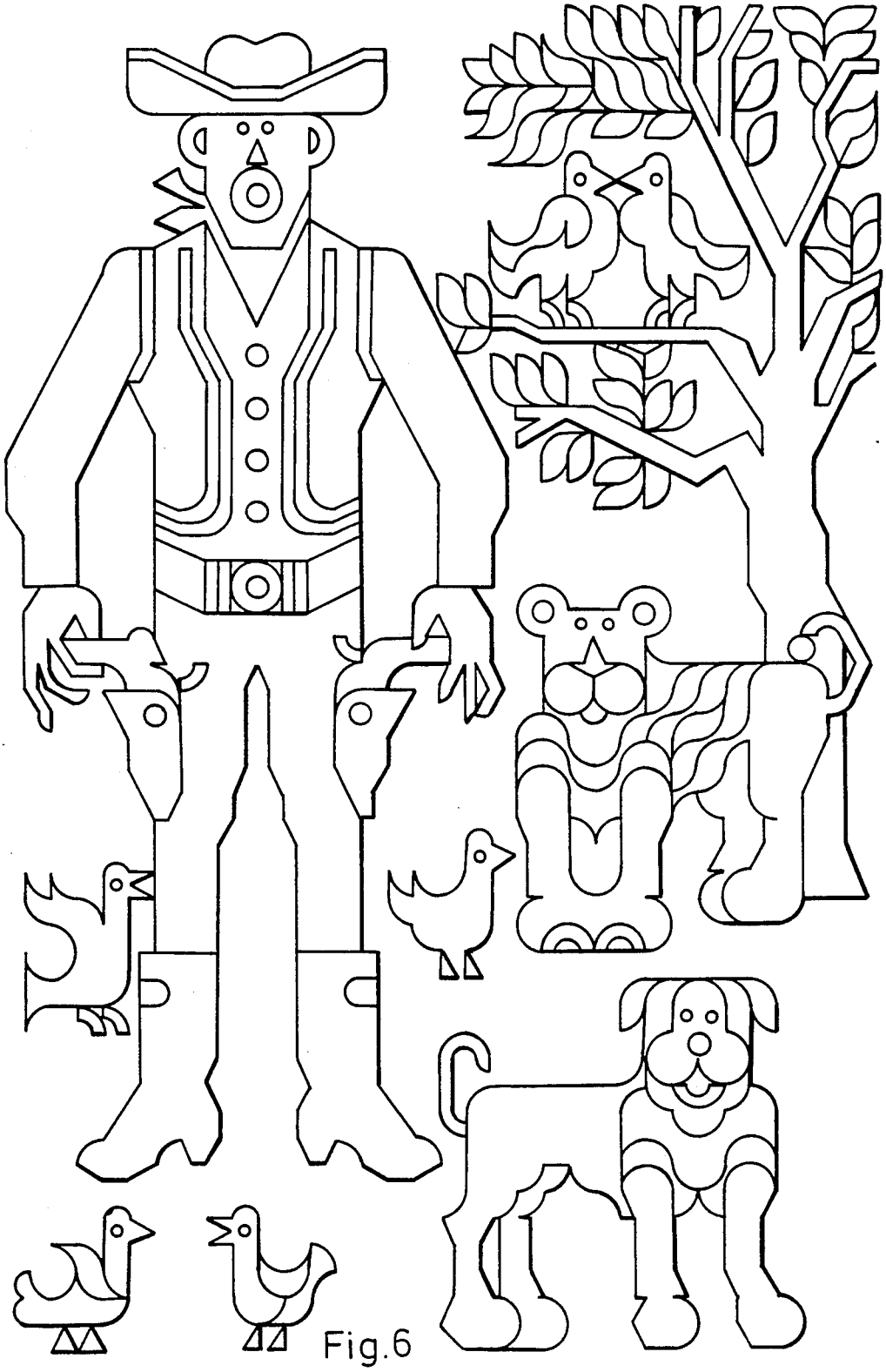
Figure 7:
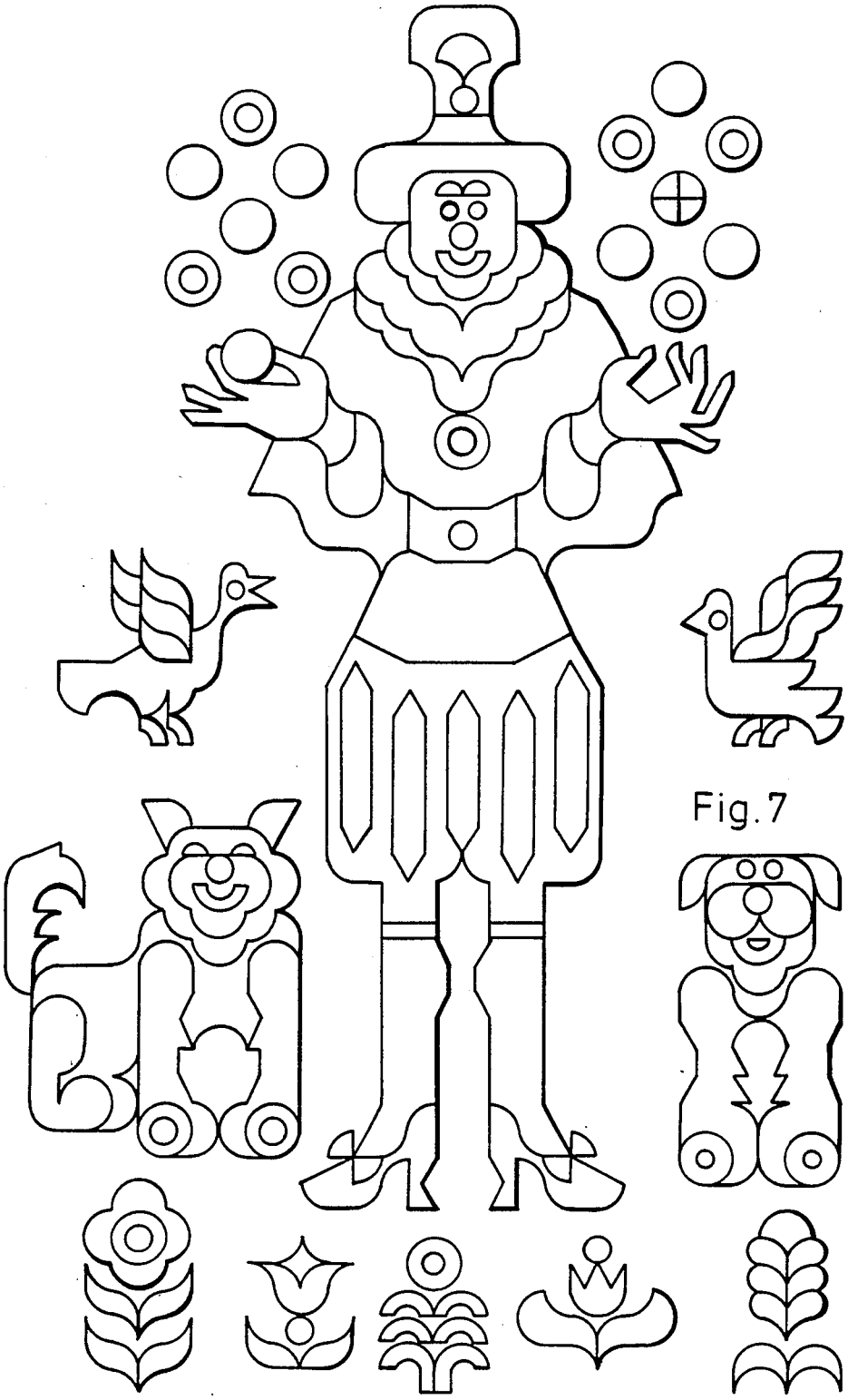
Figure 8:
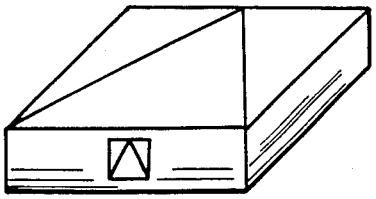
Figure 9:
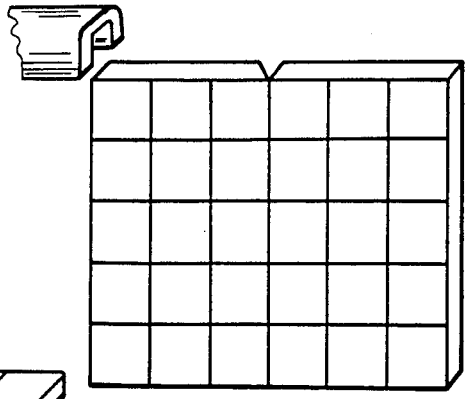
Figure 10:
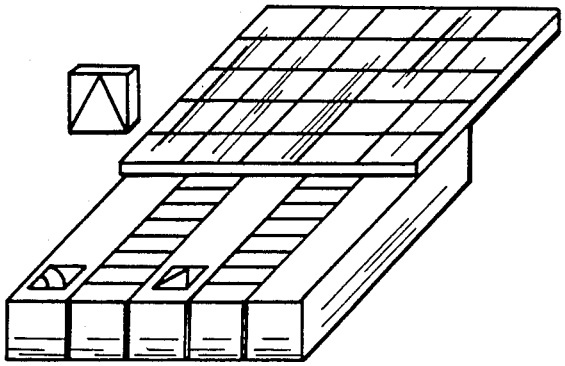
Figure 11:
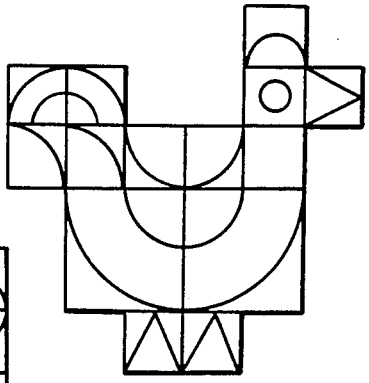
Figure 12:
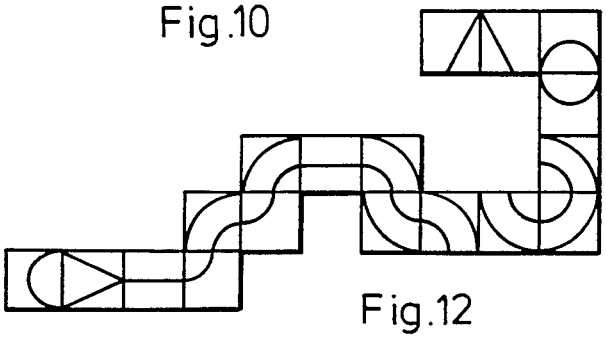
Figure 13:
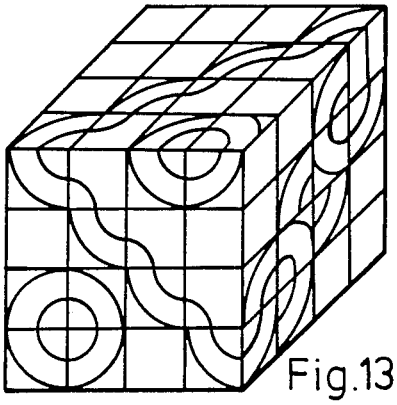
Figure 14:
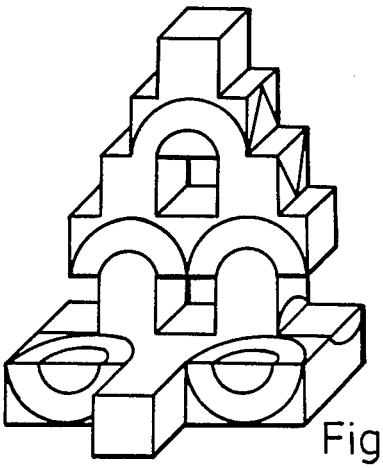

In the drawings:

FIG. 1 shows the main types of elements of the set according to the invention,

FIG. 2 is a schematic representation of the geometric interrelations between patterns of the different types of elements, FIG. 3 illustrates the location of the preferable colours in the colour triangle, FIGS. 4 to 7 show numerous picture compositions which can be made by the set according to the invention, FIG. 8 shows an enlarged view of an element with a marking on a side surface, FIG. 9 shows a playing board with a grid shown in a distorted scale for the sake of better illustration, FIG. 10 shows a perspective view of the storage box of the set, FIG. 11 illustrates an example of the combination of two groups of elements with different sizes in a composition, FIG. 12 illustrates a partial setting of a surface, FIG. 13 shows a spatial structure having cubic elements and FIG. 14 shows a spatial structure partially filling the available space using cubic elements.

FIG. 1 shows the main types of elements of the set made according to the invention. For the design of the set it is of importance that an outer surface /in the drawing the upper one/ of the elements has a square form, which comprises one or more patterns made according to predetermined rules. FIG. 1*a* shows an element without patterns with a surface that can be any one of the discrete colours associated with the set. Such surfaces are always unicoloured. FIGS. 1*b*–1*f* show elements with patterns that have arced contour lines. The term "pattern" designates a single closed surface area shown by the hatched lines in the drawing which is preferably unicoloured and differs from the colour of the remaining part of the surface. While each element in FIGS. 1*b*–1*e* comprises a single pattern only, the element of FIG. 1*f* includes a pair of patterns. The element types that comprise an arced pattern or patterns form a separate group.

FIGS. 1*g*–1*n* show element types with one or two patterns that have linear contour lines. In these cases also the colour of the pattern differs from that of the rest of the surface. The element types with linear patterns form another group of elements.

FIG. 2 illustrates the geometrical relationships which define the form of the respective patterns. The square has a side length 2A and the half-length A forms the basic dimensional unit of the set. It is true for all arced patterns that the diameter of the circular arc sections is a multiple of A. This multiple is 1 in the case of FIG. 1*b*, it is 2 in the case of the patterns of FIGS. 1*c*, 1*d*, and 1*f* /inner arc/, and it is 4 in case of FIG. 1*e* and the outer arc of FIG. 1*f*.

The center point of the arc can fall at the center of the square /FIG. 1*b*/, at the midpoint of a side /FIG. 1*c*/ or at a corner point /FIGS. 1*d*, 1*e*, 1*f*/. The maximum number of the patterns that can be allocated in a square surface is limited by the fact that the respective patterns must be separate, i.e. they do not overlap each other, and the respective elements can comprise either linear or arced patterns.

All of the linear patterns have two apex points located at two end points of a first side of the square and one or two additional apex points located at the midpoint of one or both of the neighbouring sides. There are only two different patterns in this linear group, the first is a right triangle with a base of 2A and a height A and the second is a rectangle with sides of A and 2A respectively.

FIG. 3 illustrates the preferable discrete colours for the surfaces and patterns of the set. The three basic colours, i.e. blue, red and yellow, should be used in the set. These basic colours are designated by B, R and Y at the vertices of the triangle of colours. In the triangle the mixed colours of any pairs of basic colours fall on the linear section interconnecting the vertices corresponding to the basic colours. It is preferable if in addition to the basic colours the discrete colours of the set comprise the equally balanced mixtures of any two basic colours, i.e. the green, violet and orange designated by points G, V and O respectively. If more than one shade of a mixture is required, then at most two mixture colours of any pair can be used so that the distance between these points and the basic colours should be equal if possible. Such mixtures are e.g. the blue-green /point BG/ and the yellow-green /point YG/, or the blue-violet /point BV/ and the red-violet /point RV/. In the case of two mixture colours the mid colours should not be used, if possible.

By the suitable combination of the discrete colours of the set, attractive types of elements can be designed. The size of the set is determined by the choice of colours and by the number of types of elements. It should be noted that even the smallest set should comprise at least two different types of elements from the linear group and two different types from the arced group, because the combinative application of the linear and arced patterns provides for the possibility of making attractive designs.

The preferable choice of colours cannot be illustrated due to printing limitations of the enclosed drawing, however, for those skilled in the art, it will be apparent that the suggested choice of colours provides for the dynamic and gay impression offered by the figurative patterns that can be made by the set.

According to the size of the sets more or fewer elements of the same type can be used, and the number of identical elements need not be the same for all types.

FIGS. 4 to 7 show numerous examples of the figures that can be formed by the set according to the invention, in which a grid with a 1 mm gradation is used for facilitating the recognition of the respective types. In the drawing the respective elements are 5×5 millimeters large, thus in the squares with 1 cm lengths shown by the heavier lines four elements are always arranged. For the sake of better illustration only those contour lines of the patterns or elements are shown that separate surface areas with different colours.

Figure 4:
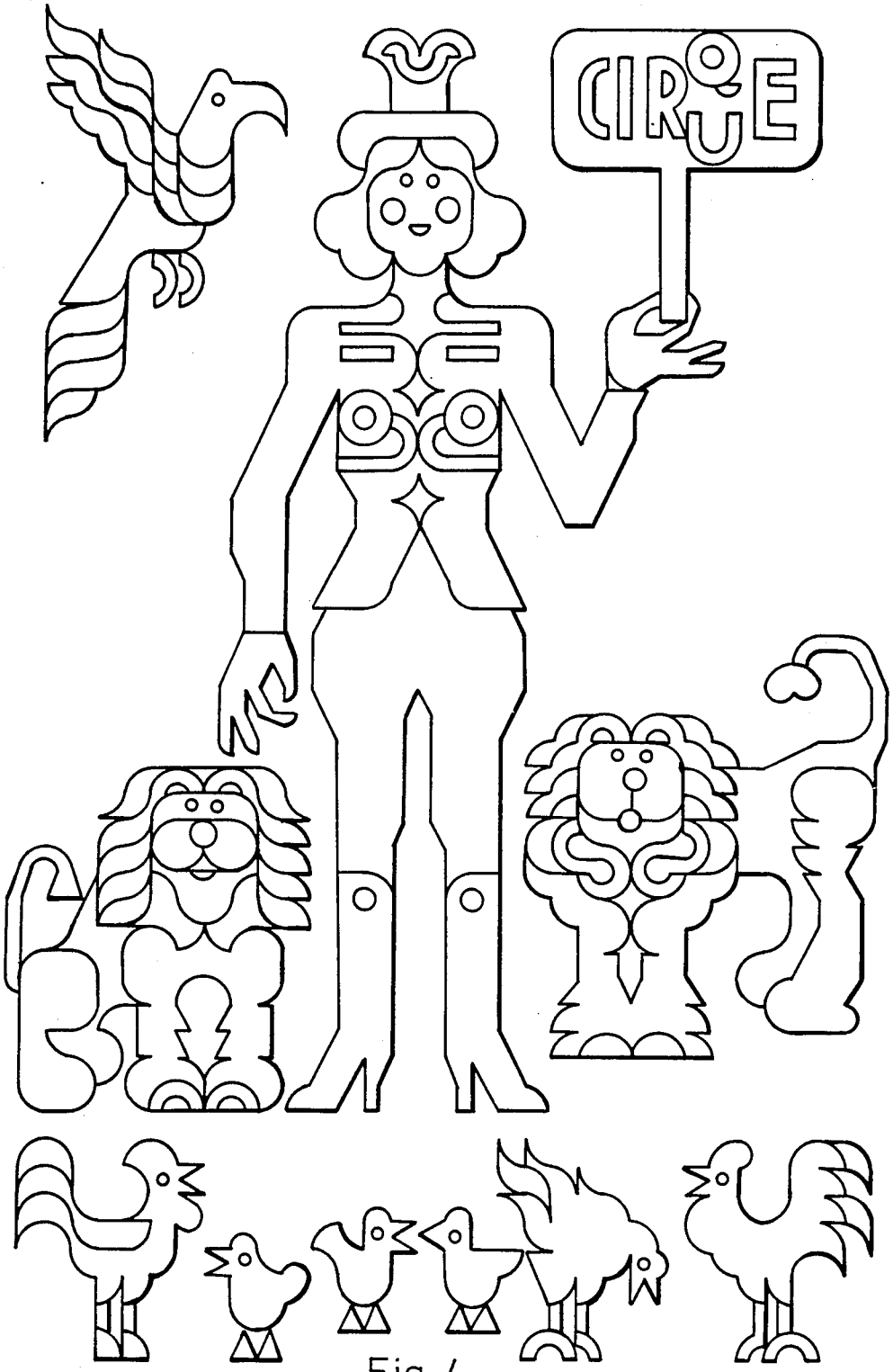

The simplified chicks shown in the lower part of FIG. 4 do not need a larger field than one including 5×4 elements. Even such a small number of elements can already provide for a typical and expressive representation. The size of the hens and cocks shown in the same field corresponds to an array of 8×7 elements. The representation of the lion and the flying bird can be made by an array of 16×14 elements. This field area has a still acceptable size, since the side-length of the elements is preferably between 20 and 40 mm. In the way as shown in FIG. 4 the elements can be used for making letters, inscriptions and tables all having a characteristic appearance. The full drawing field presents in the example a stylized tale composition.

Figure 5:
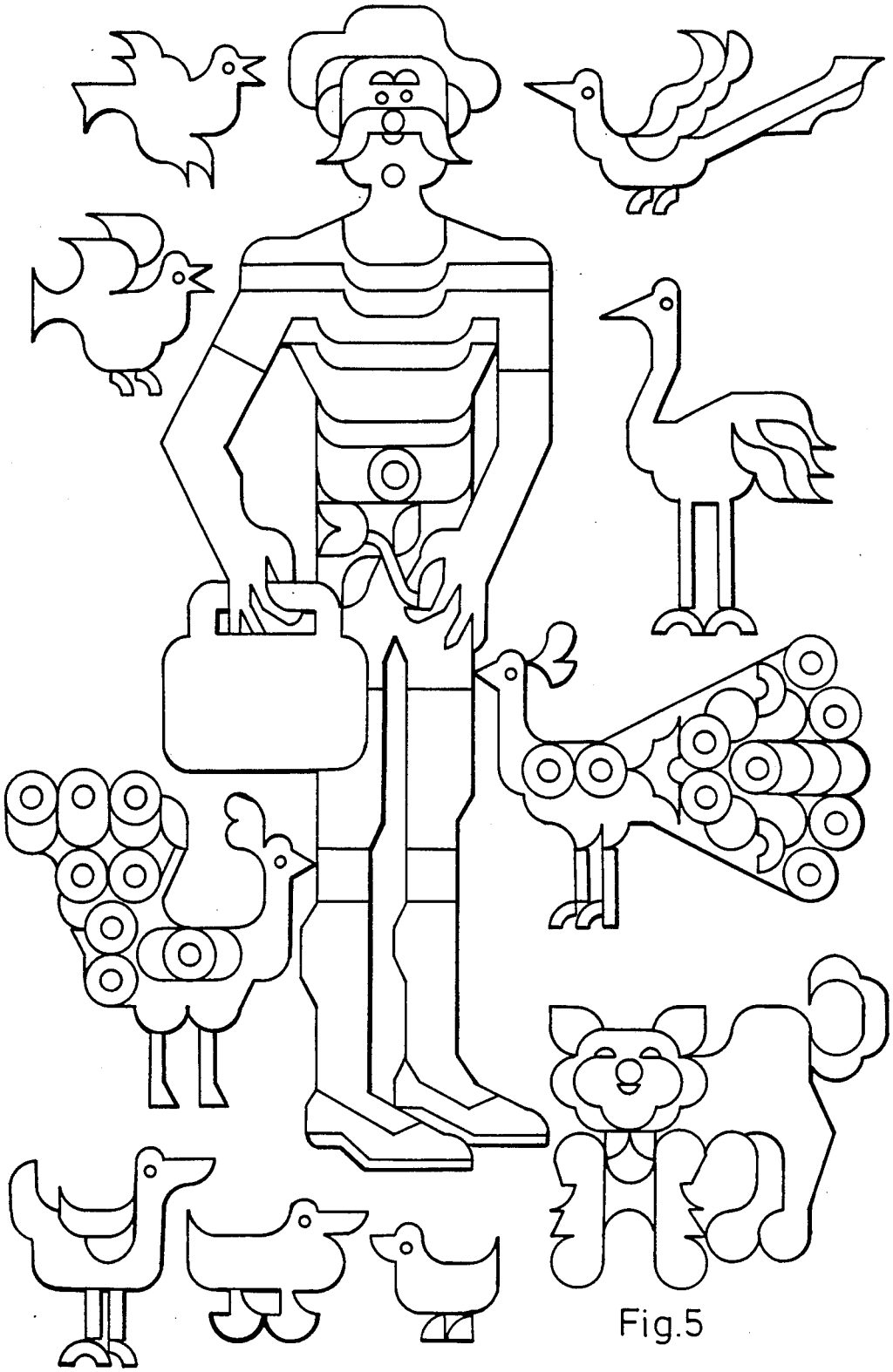

The figurative versatility and richness can be shown also in FIG. 5, which presents small, medium and large animal figures all rich in details, and the animals have Hungarian folkloristic characters and the standing male figure concentrates the attention in the middle of the composition.

The animals of FIG. 6 present another world of folktales with the same richness and expressivity.

FIG. 7 shows an example from the world of a circus with simple motifs, flowers and a clown acting as a juggler.

These examples illustrate that the square elements grouped in a plurality of types as shown in FIG. 1 can be used for making a large number of patterns and various figures. Unlike the puzzle toys, the opportunity for creative phantasy provided by the invention is not limited by any kind of rules and the child can create while playing and its sense of colour develops.

The elements of the combinative set according to the invention can be designed as flat square prisms as shown in FIG. 8. In that case a small storage place is required for the set. It is preferable if in the side opposite to that comprising the patterns, the element material includes a hard ferrite powder mixed evenly in the plastic material and magnetized to form a magnet. FIG. 9 shows a playing board which comprises a magnetizable upper layer of a soft magnetic powder, whereby the elements will be fixed on the board by the magnetic attractive force. It is preferable if the board comprises a grid with a spacing corresponding to the size of the elements. The board should have a foldable design for facilitating its storage in a box. In unfolded state the playing board is reinforced by the application of a U-rail member as shown in FIG. 9.

The side face of the element shown in FIG. 8 comprises the sketch of the pattern associated with that particular element. This kind of marking facilitates the proper selection of elements when being stored in a box or the insertion of the elements in the right order in the box. FIG. 10 shows a preferable design of a storage box for the set, in which the elements are inserted along their side faces in respective vertical slots. A horizontal surface between the upper ends of the recesses serves as a support for the playing board. Appropriate marking signs can be made on this surface showing the types of the elements which should be inserted in the corresponding slots. The marking helps in putting the elements in the box in the right arrangement. A recess is provided just above the support surface for locating the playing board in a folded position, and the recess is covered by a sliding cover plate.

In the examples referred to hereinabove the side length of each element was the same. It is, however, possible to design a toy set, in which the elements can be assigned to groups with different side-lengths. FIG. 11 shows for example a chick consisting of elements with full and half sizes. The application of smaller elements facilitates the representation of smaller details. For the required esthetical connection between the elements it is of significance that the relationship between the length of different elements be 1:2.

FIG. 12 shows an example in which the elements do not fully occupy the available surface area of the playing board, whereby a snake-like form is obtained. This form is rather close to the abstract representation.

The elements shown in FIGS. 13 and 14 have not only a single quadratic face, since they are made of regular cubes, therefore they have six faces available for utilisation. FIG. 13 shows a compact spatial design with a waving spatial pattern on the outer surface that breaks the monotony of the otherwise dull prismatic body. FIG. 14 shows a free spatial composition. In such designs it is preferable if an appropriate number of each cube-surface remains unicoloured without any pattern, whereby the spatial construction can make a certain kind of balanced impression on the viewer.

On the basis of the examples it can be seen that the number of combinations that can be designed by the set of elements according to the invention is practically unlimited, and with the particular forms of patterns an active coupling takes place between the neighbouring quadratic surfaces. Such an active coupling has been quite unknown in case of conventional toys designed for displaying letters or numbers. In view of these features the comparatively small number of types forms the basis of a large number of advantages. This property enables e.g. the application of the set of elements according to the invention for making surface decorations e.g. in the form of tiles, ornamentical surface elements or glass plates.

The specific forms of the patterns offer a uniform character of appearance for the various displayable figures which generally meets the esthetical standards of grown up and children players.

I claim:

1. A combinable set of quadratic elements for laying out quadratic surfaces having variable appearance, with the sides of the surfaces being equal, said quadratic surfaces being divided into types of patterns with geometric dimensions equal to the half or the whole of the sides of each quadratic surface of different appearance, in which the number of quadratic elements is greater than the number of types comprising the following types where the quadratic surface is:

(a) uniform in color;

(b) divided into several non-overlapping and differently colored surfaces, with said colored surfaces adjoining along a 90-degree circular arc, the center of curvature of which lies in a corner and the radius of which equals half the length of the side of the quadratic surface;

(c) divided into several non-overlapping and differently colored surfaces, adjoining along a 90-degree circular arc, the center of curvature of which lies in a corner and the radius of which equals the length of the side of the quadratic surface;

(d) divided into three different colored surfaces, adjoining along respective 90-degree circular arcs, the center of curvature of the two arcs lying in a common corner, whereby the radii of the arcs respectively equal half the length and the length of the side of the quadratic surface; and (e) divided into several non-overlapping and differently colored surfaces, adjoining along a semicircle, the center of curvature of which lies at the midpoint of a side of the quadratic surface and the radius of which equals half the length of said side.

2. The combinable set of elements as in claim 1, further comprising an additional type wherein the quadratic surface is divided in two colored surfaces which adjoin along a circle, the center of which lies in the middle of the quadratic surface and the diameter of which equals half the length of a side of the quadratic surface.

3. The set of elements as in claim 1, wherein the colors of the colored surfaces are primary colors, i.e. blue, red or yellow, and predetermined combination colors of selected pairs of primary colors and the number of colors used on one quadratic surface is at most three.

4. The set of elements as in claim 1 wherein the elements are formed from flat quadratic prisms which have a hard ferromagnetic layer on the side opposite the colored surface.

5. The set of elements as in claim 4 wherein a play board is provided with a grid of lines spaced corresponding to the size of the elements, and having a magnetic topside foldable along at least one line.

6. The set of elements as in claim 1 wherein the elements are formed as cubes.

7. The set of elements as in claim 6, wherein several of the cube surfaces are colored surfaces of one of the foregoing types.

8. The set of claims as defined in claim 1, wherein said elements include elements of a first size having a quadratic surface with a first predetermined side length and elements of a second size having a quadratic surface with a second predetermined side length, said predetermined side length being substantially equal to twice said first predetermined side length.

9. The set of elements as defined in claim 8, wherein at least some of said elements of said first size and at least some of said elements of said second size have quadratic surfaces of the same type.

10. A combinable set of quadratic elements for laying out quadratic surfaces having variable appearance, with the sides of the surfaces being equal, said quadratic surfaces being divided into types of patterns with geometric dimensions equal to the half or the whole of the sides of each quadratic surface, of different appearance, in which the number of quadratic elements is greater than the number of types comprising the following types where the quadratic surface is:

(a) uniform in color;

(b) divided into several non-overlapping and differently colored surfaces, with said colored surfaces adjoining along a 90-degree circular arc, the center of curvature of which lies in a corner and the radius of which equals half the length of the side of the quadratic surface;

(c) divided into several non-overlapping and differently colored surfaces, adjoining along a 90-degree circular arc, the center of curvature of which lies in a corner and the radius of which equals the length of the side of the quadratic surface;

(d) divided into three different colored surfaces, adjoining along respective 90-degree circular arcs, the center of curvature of the two arcs lying in a common corner, whereby the radii of the arcs respectively equal half the length and the length of the side of the quadratic surface; and (e) divided into several non-overlapping and differently colored surfaces, adjoining along a straight line, connecting a midpoint of a quadratic surface and a corner thereof; and (f) divided into two different colored surfaces adjoining along a straight line, which line connects the midpoints of two opposing sides.

11. The combinable set of elements as in claim 10, further comprising an additional type wherein the quadratic surface is divided into three different colored surfaces, the first and second of which adjoin along a straight line which connects a midpoint of a side and a corner of the quadratic surface, and the second and third of which adjoin along a straight line which connects said midpoint of said side and a midpoint of the opposing side of the quadratic surface;

12. The combinable set of elements as in claim 10, further comprising an additional type wherein the quadratic surface is divided into several non-overlapping and differently colored surfaces, adjoining along a semicircle, the center of curvature of which lies at the midpoint of a side of the quadratic surface and the radius of which equals half the length of said side.

13. The combinable set of elements as in claim 10, further comprising an additional type wherein the quadratic surface is divided in two colored surfaces which adjoin along a circle, the center of which lies in the middle of the quadratic surface and the diameter of which equals half the length of a side of the quadratic surface.

14. The set of elements as defined in claim 10, wherein said elements include elements of a first size having a square surface with a first predetermined side length and elements of a second size having a square surface with a second predetermined side length, said second predetermined side length being substantially equal to twice said first predetermined side length.

15. The set of elements as defined in claim 14, wherein at least some of said elements of said first size and at least some of said elements of said second size have square surfaces of the same type.

* * * * *